US009092044B2

(12) United States Patent
Van Tran et al.

(10) Patent No.: US 9,092,044 B2
(45) Date of Patent: Jul. 28, 2015

(54) LOW VOLTAGE, LOW POWER BANDGAP CIRCUIT

(75) Inventors: Hieu Van Tran, San Jose, CA (US); Anh Ly, San Jose, CA (US); Thuan Vu, San Jose, CA (US); Hung Quoc Nguyen, Fremont, CA (US)

(73) Assignee: Silicon Storage Technology, Inc., San Jose, CA (US)

( * ) Notice: Subject to any disclaimer, the term of this patent is extended or adjusted under 35 U.S.C. 154(b) by 157 days.

(21) Appl. No.: 13/286,843

(22) Filed: Nov. 1, 2011

(65) Prior Publication Data

US 2013/0106391 A1 May 2, 2013

(51) Int. Cl.
*G05F 3/02* (2006.01)
*G05F 3/30* (2006.01)

(52) U.S. Cl.
CPC ..... *G05F 3/30* (2013.01)

(58) Field of Classification Search
CPC ..... G05F 3/02
USPC ..... 323/312, 316
See application file for complete search history.

(56) References Cited

U.S. PATENT DOCUMENTS

| | | | | |
|---|---|---|---|---|
| 5,783,934 | A * | 7/1998 | Tran | 323/312 |
| 6,590,372 | B1 | 7/2003 | Wiles, Jr. | |
| 6,943,617 | B2 | 9/2005 | Tran et al. | |
| 7,605,654 | B2 * | 10/2009 | Yen et al. | 330/253 |
| 2005/0088163 | A1 * | 4/2005 | Tachibana et al. | 323/313 |
| 2005/0140428 | A1 | 6/2005 | Tran et al. | |
| 2007/0126495 | A1 | 6/2007 | Ivanov et al. | |
| 2008/0157746 | A1 * | 7/2008 | Chen | 323/313 |
| 2009/0146625 | A1 * | 6/2009 | Huang et al. | 323/272 |
| 2010/0164467 | A1 * | 7/2010 | Jo | 323/313 |
| 2011/0025291 | A1 * | 2/2011 | Lee et al. | 323/313 |
| 2011/0175593 | A1 * | 7/2011 | Ookuma | 323/313 |
| 2013/0082676 | A1 * | 4/2013 | Ivanov et al. | 323/316 |

FOREIGN PATENT DOCUMENTS

| | | | |
|---|---|---|---|
| CN | 1610946 | A | 4/2005 |
| CN | 100498639 | | 6/2009 |
| CN | 101505141 | A | 8/2009 |
| CN | 101753145 | A | 6/2010 |
| TW | 200827978 | A | 7/2008 |
| WO | 2011 037693 | A1 | 3/2011 |

OTHER PUBLICATIONS

PCT Search Report and Written Opinion dated Jan. 4, 2013 corresponding to the related PCT Patent Application No. US12/59617.
Taiwanese Office Official Letter and Search Report dated Oct. 7, 2014 corresponding to related Taiwanese Patent Application No. 101138703.
Chinese Office Action dated Jan. 30, 2015 corresponding to related Chinese Patent Application No. 201280065656.0.

* cited by examiner

*Primary Examiner* — Adolf Berhane
*Assistant Examiner* — Jye-June Lee
(74) *Attorney, Agent, or Firm* — DLA Piper LLP (US)

(57) ABSTRACT

A bandgap voltage generating circuit for generating a bandgap voltage has an operational amplifier that has two inputs and an output. A current mirror circuit has at least two parallel current paths. Each of the current paths is controlled by the output from the operational amplifier. One of the current paths is coupled to one of the two inputs to the operational amplifier. A resistor divide circuit is connected to the other current path. The resistor divide circuit provides the bandgap voltage of the circuit.

17 Claims, 14 Drawing Sheets

LOW VOLTAGE, LOW POWER BANDGAP CIRCUIT

TECHNICAL FIELD

The present invention relates to a bandgap voltage generating circuit, and more particularly to a low power circuit for generating a low bandgap voltage.

BACKGROUND OF THE INVENTION

Bandgap voltage generating circuits are well known in the art. See for example U.S. Pat. No. 6,943,617. Referring to FIG. 1 there is shown a bandgap voltage generating circuit 10 of the prior art. The circuit 10 comprises two parallel current paths, marked as I1 and I2. The current in the path I2 is I2=(Vbe1−Vbe2)/R0=dVbe/R0 (where Vbe1 is the voltage across the base-emitter of the bipolar transistor 12 in current path I1 and Vbe2 is the voltage across the base-emitter of the bipolar transistor 14 of current path I2). dVbe=VT*ln (N), where VT is thermal voltage k*T/q, k=Boltzmann constant, q=electron charge; hence is proportional to absolute temperature (PTAT). Vbe is complementary (or negative) to absolute temperature (CTAT). The output bandgap voltage Vbg=(R1/R0) dVbe+Vbe3 (where Vbe3 is the voltage across the base-emitter of the bipolar transistor 16 in current path I3). The size of the emitter of the bipolar transistor 12 and the bipolar transistor 16 are substantially the same, while the size of the emitter of the bipolar transistor 14 is approximately N times the size of the emitter of the bipolar transistor 12. In general, the disadvantage of the circuit 10 is that the minimum bandgap voltage is high, (on the order of >2 volts).

Referring to FIG. 2 there is shown another bandgap voltage generating circuit 20 of the prior art. The circuit 20 is similar to the circuit 10 shown in FIG. 1 except with the addition of a charge pump as shown. However, the result is similar to the circuit 10 shown in FIG. 1 in that the minimum bandgap voltage is on the order of >2 volts.

Referring to FIG. 3 there is shown yet another bandgap voltage generating circuit 30 of the prior art. The circuit 30 comprises an operational amplifier 32 with two inputs and one output. The operational amplifier 32 receives inputs from a current mirror (34*a* & 34*b*). The output of the operational amplifier 32 is used to control a PMOS transistor pair 36 (which is equivalent to one PMOS transistor, circuit wise) connected in series with a resistor 38, with the output of the bandgap voltage taken from the connection of the PMOS transistor pair 36 with the resistor 38. Although the output of the bandgap voltage can be as low as 1.0 volts, the circuit 30 requires multiple precise circuits resulting in potential mismatches.

Referring to FIG. 4 there is shown yet another bandgap voltage generating circuit 40 of the prior art. The circuit 40 comprises an operational amplifier 42 with two inputs and one output. One of the input is taken from a resistor divide circuit (comprising resistors R1 and R2), while the other is from a parallel circuit. The output is used to control the current path through the two circuits. The output of the bandgap voltage is on the order of 1.25 volts.

As more and more electronic devices become portable and use battery as a source of power, this requires the bandgap circuit to have low power consumption as well as being able to generate a low voltage. Hence there is a need for a low voltage, low power bandgap circuit.

SUMMARY OF THE INVENTION

A bandgap voltage generating circuit for generating a bandgap voltage comprises an operational amplifier that has two inputs and an output. A current mirror circuit has at least two parallel current paths. Each of the current paths is controlled by the output from the operational amplifier. One of the current paths is coupled to one of the two inputs to the operational amplifier. A resistor divide circuit is connected to the other current path. The resistor divide circuit provides said bandgap voltage.

DETAILED DESCRIPTION OF THE PREFERRED EMBODIMENT

Figure 1:
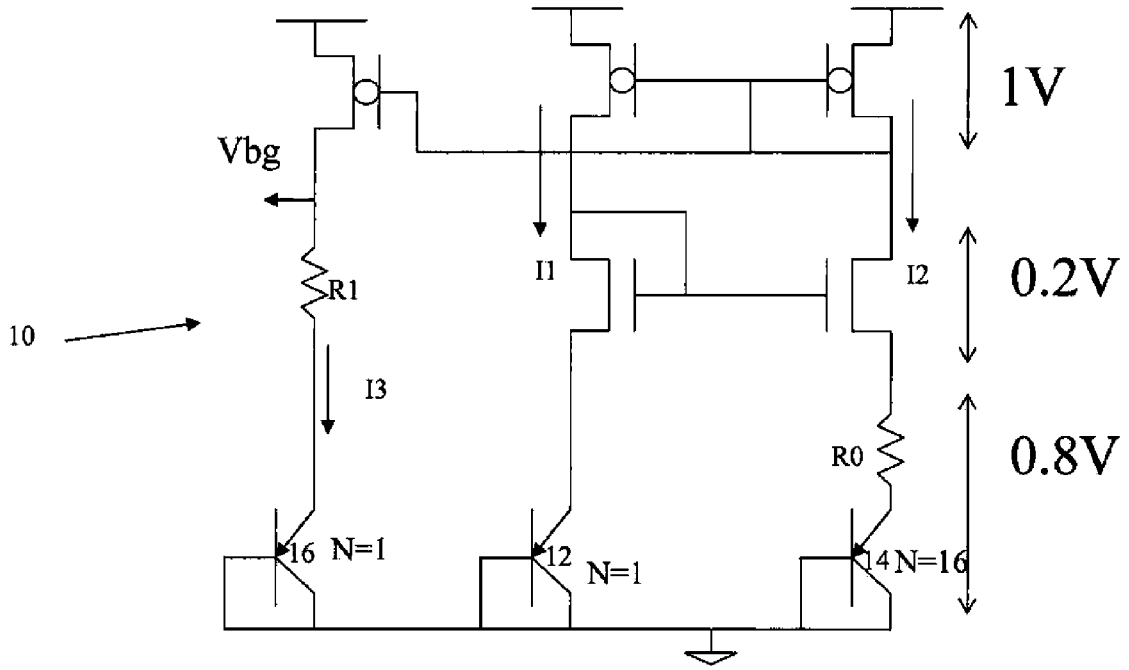
Figure 1 (Prior Art)
FIG. 1 is a circuit diagram of a bandgap circuit of the prior art.
Figure 2:
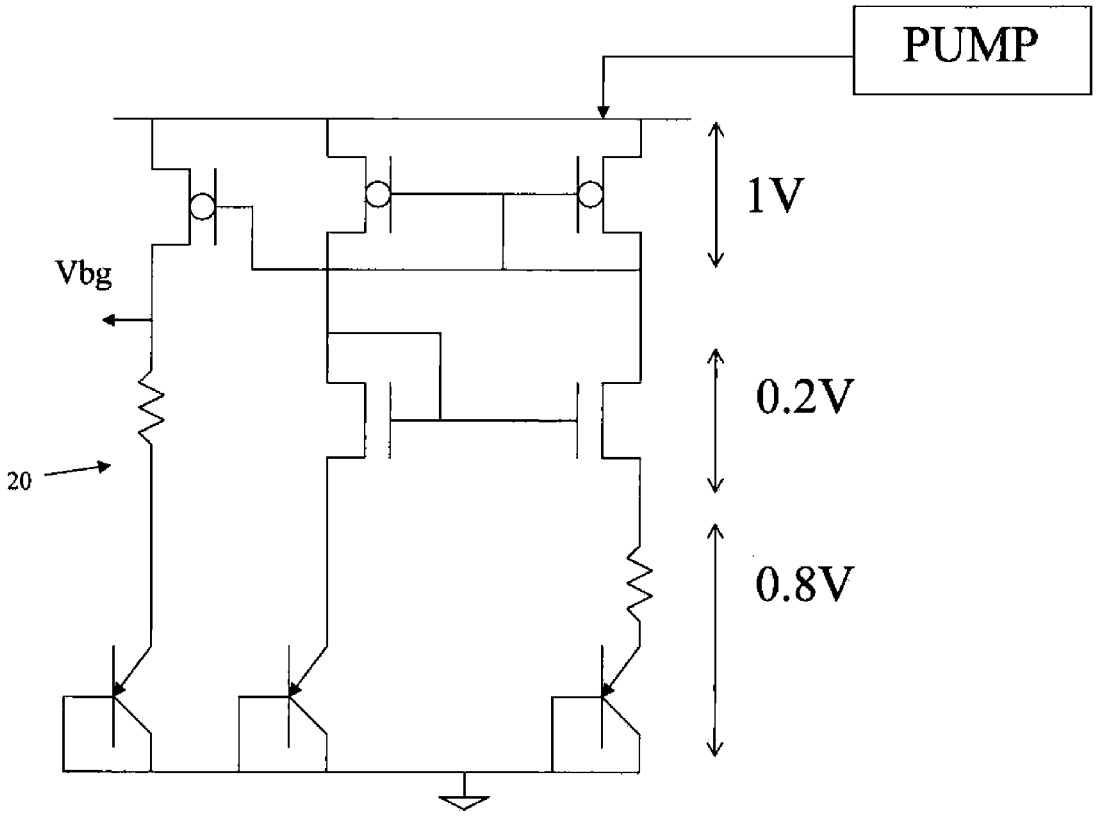
Figure 2 (Prior Art)
FIG. 2 is a circuit diagram of another bandgap circuit of the prior art.
Figure 3:
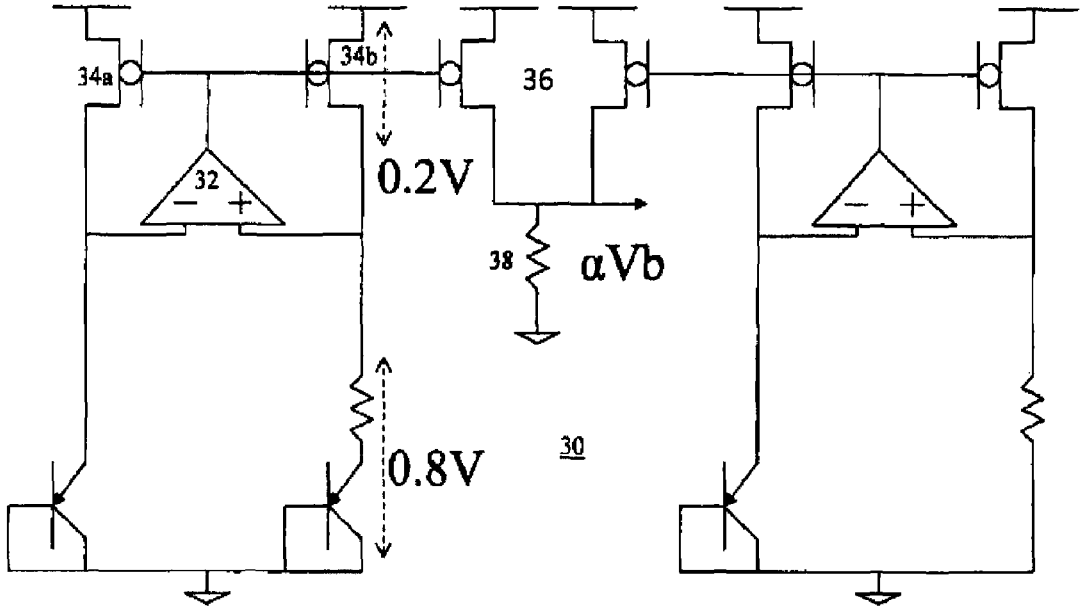
Figure 3 (Prior Art)
FIG. 3 is a circuit diagram of yet another bandgap circuit of the prior art.
Figure 4:
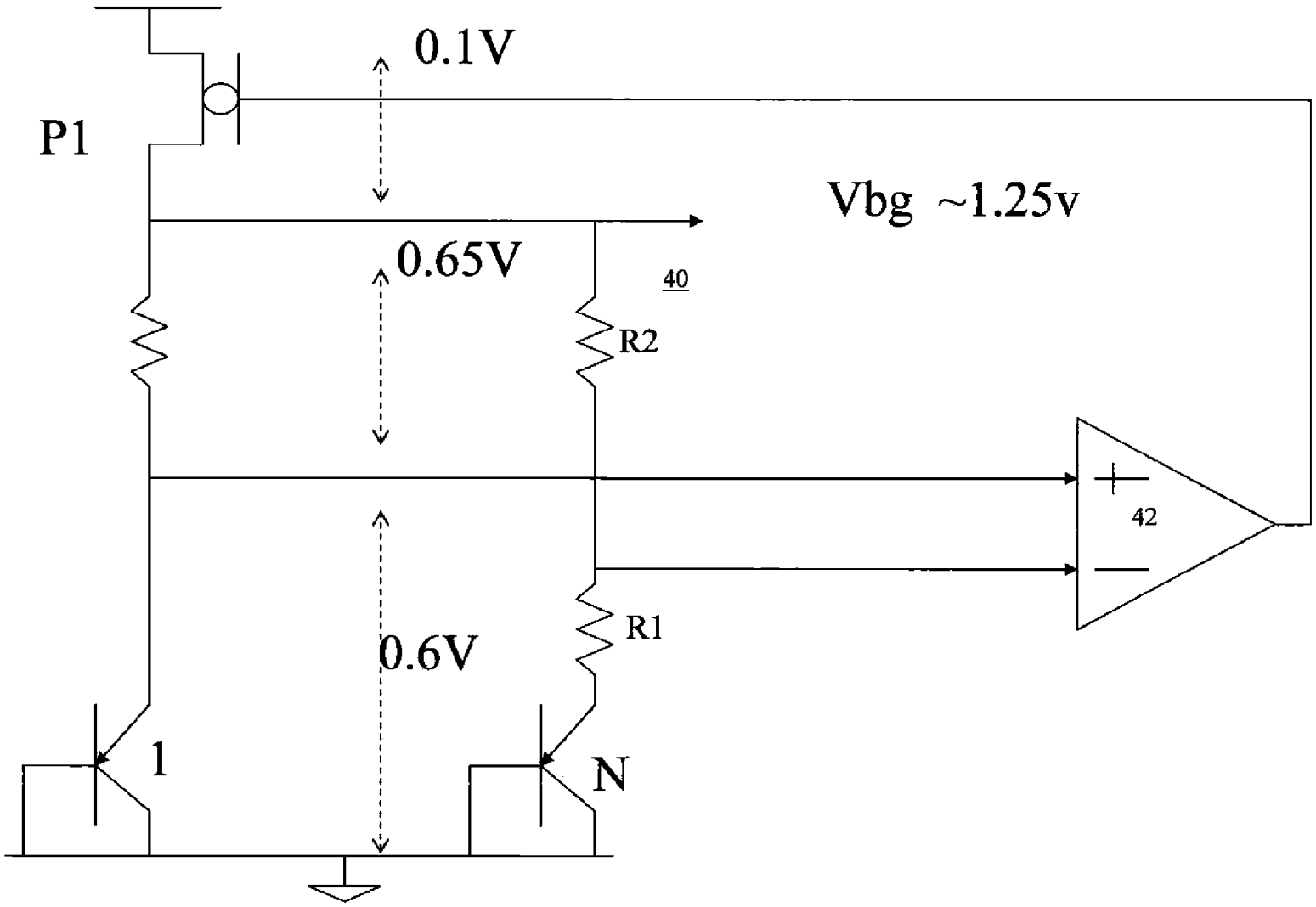
Figure 4 (Prior Art)
FIG. 4 is a circuit diagram of yet another bandgap circuit of the prior art.
Figure 5:
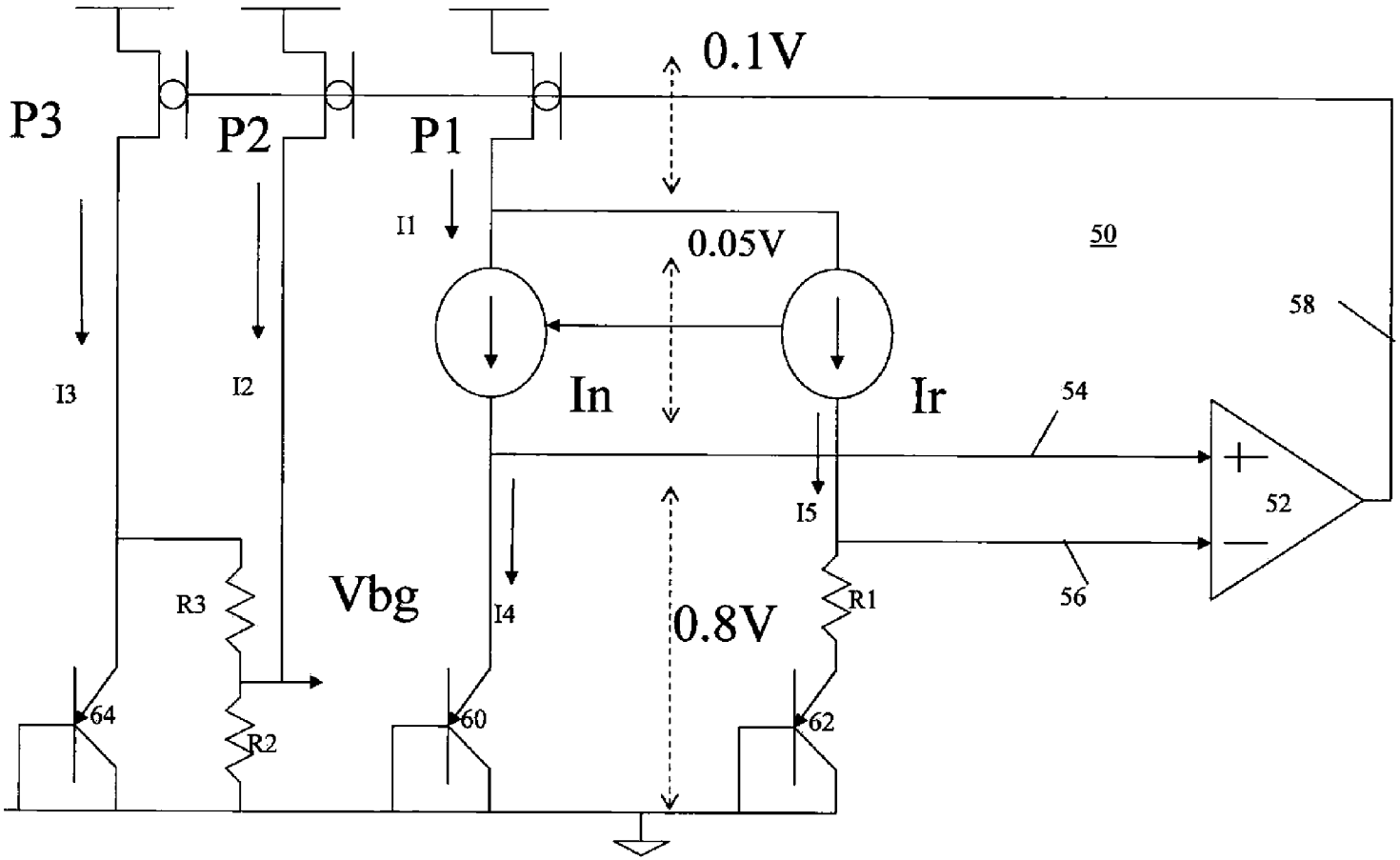
FIG. 5 is a circuit diagram of a first embodiment of the bandgap circuit of the present invention.

Referring to FIG. 5 there is shown a first embodiment of the bandgap circuit 50 of the present invention. The circuit 50 comprises an operational amplifier (op amp) 52, which has a first non-inverting input 54, an inverting second input 56, and an output 58. The output 58 is connected to the gate of three PMOS transistors: P1, P2 and P3. Each of the transistors P1, P2 and P3 is connected in series with a current path I1, I2 and I3, which are all in parallel. The output 58 controls the flow of current in the current paths I1, I2 and I3. The current path I1 is connect to parallel current subpaths: I4 and I5. Each of the current subpaths I4 and I5 has a equivalent current source (In and Ir respectively) connected in series. The output of the current sources In and Ir, respectively, is connected to the inputs 54 and 56 to the operational amplifier 52 respectively. The current source In is connected to the emitter of a PNP bipolar transistor 60, whose base and collector are connected to each other, and to ground. The current source Ir is connected to a resistor R1, which is then connected to the emitter of a PNP bipolar transistor 62, whose base and collector are connected to each other, and to ground. The emitter of the transistor 62 has a ratio of N times that of the emitter of the transistor 60. The current Ir is determined by the current I5 which is dVbe/R1 (dVbe=Vbe of PNP 60−Vbe of PNP 64). The current I4 is determined by the current In, which is determined by a current mirro ratio In/Ir. The current I1, I4, I5 are hence proportional to absolute temperature (PTAT). The third MOS transistor P3 is connected in the current path I3, (which mirrors from transistor P1 and hence PTAT), which is connected to the emitter of a PNP bipolar transistor 64, whose base and collector are connected to each other, and to ground. The emitter of transistor 64 has substantially the same area as that of bipolar transistor 60. A resistor divide circuit comprising of resistors R3 connected in series with resistor R2 is connected in parallel to the emitter/collector of transistor 64. The resistors R2 and R3 and the Vbe of the bipolar transistor 64 provide a fractional Vbe (a ratio of Vbe<Vbe at the junction of the resistor R2 and R3. The node at the junction of the resistor R2 and R3 is connected to the current path I2 and to the MOS transistor P2, and provides the output bandgap voltage Vbg.

In the operation of the circuit 50, the resistor R1 can be trimmed to compensate for temperature coefficient (TC) of the output voltage Vbg. Further the resistors R2, R3 can also be trimmed for the TC of the output voltage Vbg. The MOS transistors P1, P2 and P3 act as a current mirror for the current paths I1, I2 and I3. Further, the current subpaths I4 and I5 act as a current mirror with the current being provided in the ratio of In/Ir. As a result, the output Vbg=K1*Vbe (Vbe of transistor 64)+K2*deltaVbe. With K1=R2/(R2+R3), e.g. 0.5. And with deltaVbe=((Vbe of transistor 60)−(Vbe of transistor 62)) with K2=R2*eq*/R1, R2*eq* is the parallel combination of R2 and R3. Thus, by appropriate trimming of the resistors R1, R2 and R3, the output bandgap voltage Vbg can be made temperature independent and very small, e.g. <0.6V. Further ratio In/Ir or P2/P1 transistor sizes can be trimmed for TC of the Vbg.

Figure 6:
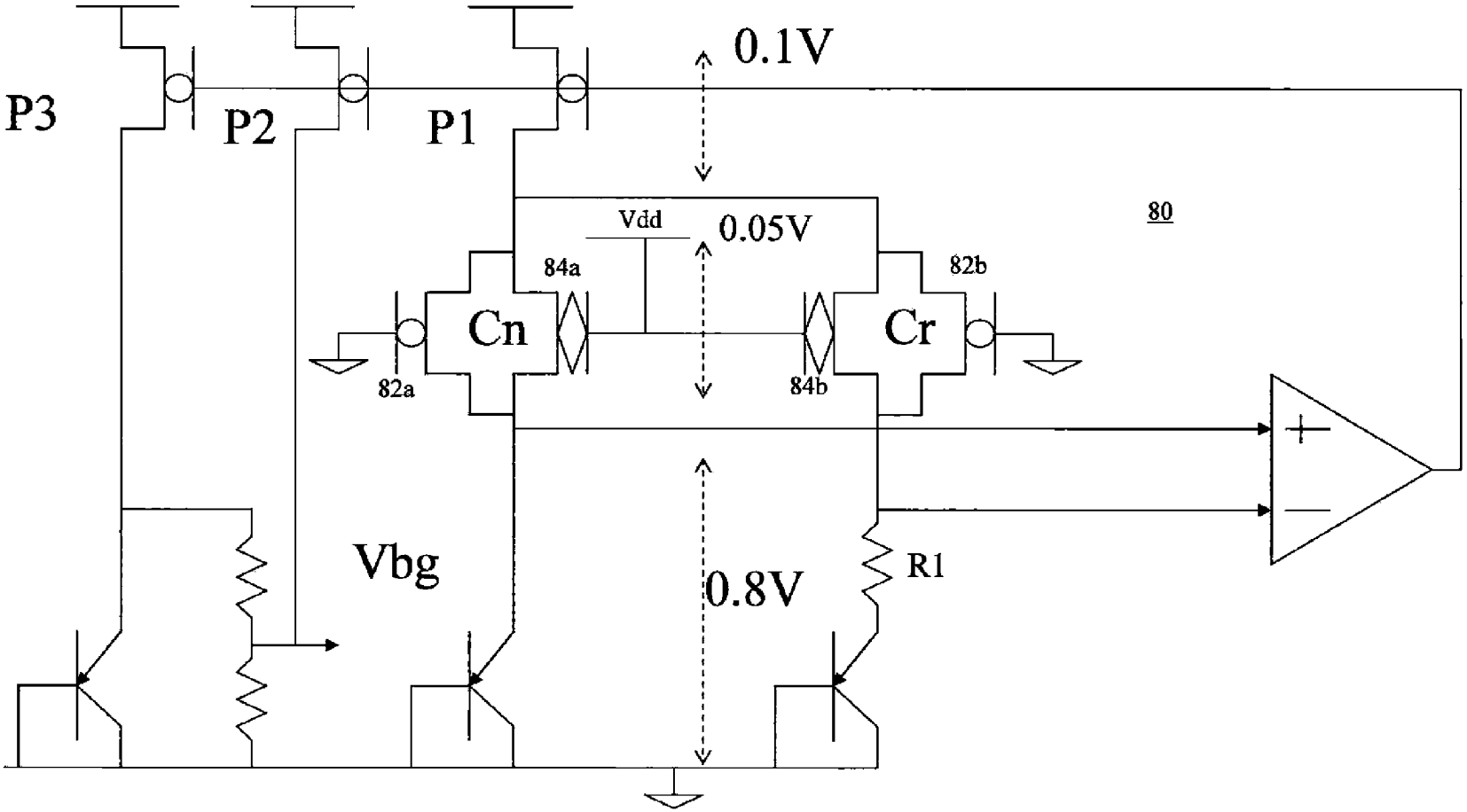
FIG. 6 is a circuit diagram of a second embodiment of the bandgap circuit of the present invention.

Referring to FIG. 6 there is shown a second embodiment of a circuit 80 of the present invention for the generation of a bandgap voltage. The circuit 80 is similar to the circuit 50 shown in FIG. 5. Thus, like numerals will be used for like parts. The only change between the circuit 80 and the circuit 50 is that the (equivalent) current source In shown in FIG. 5 is shown in FIG. 6 as comprising a PMOS transistor 82*a* connected in parallel with a native transistor 84*a*, with the gate of the PMOS transistor 82*a* connected to ground. The source/drain of the transistors 82*a* and 84*a* are connected together and are in series with the current path I4. The (equivalent) current source Ir shown in FIG. 5 is shown in FIG. 6 as comprising a PMOS transistor 82*b* connected in parallel with a native transistor 84*b*, with the gate of the PMOS transistor 82*b* connected to ground. The source/drain of the transistors 82*b* and 84*b* are connected together and are in series with the current path I5. The gates of the native transistors 84*a* and 84*b* are connected together and to a voltage source, Vdd. For low voltage operation, such as battery operation, Vdd may be on the order of 1.0-1.2 volts. In all other aspects, the circuit 80 is identical to the circuit 50 and the operation of the circuit 80 is also identical to the operation of the circuit 50. The ratio of In/Ir is determined by the ratio of the size of transistors 82*a* and 84*a* over that of transistors 82*b* and 84*b*. An alternative embodiment for In and Ir is the PMOS transistors 82*a* and 82*b* respectively without the native transistors 84*a* and 84*b*. Further gates of PMOS 82*a* and 82*b* may be biased at a control bias to simulate an equivalent resistor value (a pre-determined value) such as 100K or 1K ohms. Another alternative embodiment for In and Ir is the native transistors 84*a* and 84*b* respectively without the PMOS transistors 82*a* and 82*b*. Further gates of the native transistors 84*a* and 84*b* may be biased at a control bias to simulate an equivalent resistor value (a pre-determined value) such as 100K or 1K ohms.

Figure 7:
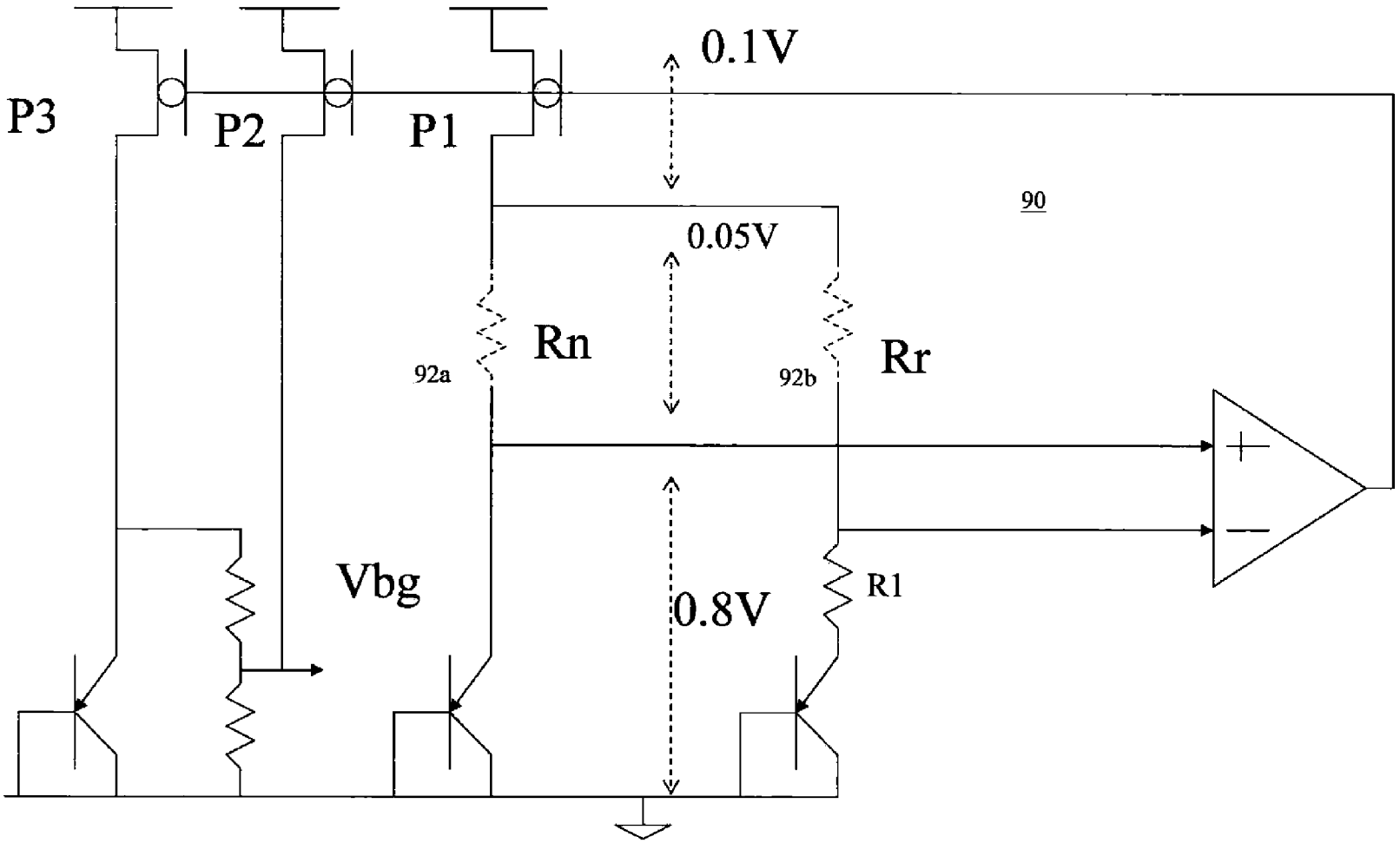
FIG. 7 is a circuit diagram of a third embodiment of the bandgap circuit of the present invention.

Referring to FIG. 7 there is shown a third embodiment of a circuit 90 of the present invention for the generation of a bandgap voltage. The circuit 90 is similar to the circuit 50 shown in FIG. 5, and to the circuit 80 shown in FIG. 6. Thus, like numerals will be used for like parts. The only change between the circuit 90 and the circuit 50 is that the current source In shown in FIG. 5 is shown in FIG. 7 as comprising a resistor 92*a*. The current source Ir shown in FIG. 5 is shown in FIG. 7 as comprising a resistor 92*b*. In all other aspects, the circuit 90 is identical to the circuit 50 and the operation of the circuit 90 is also identical to the operation of the circuit 50.

Figure 8:
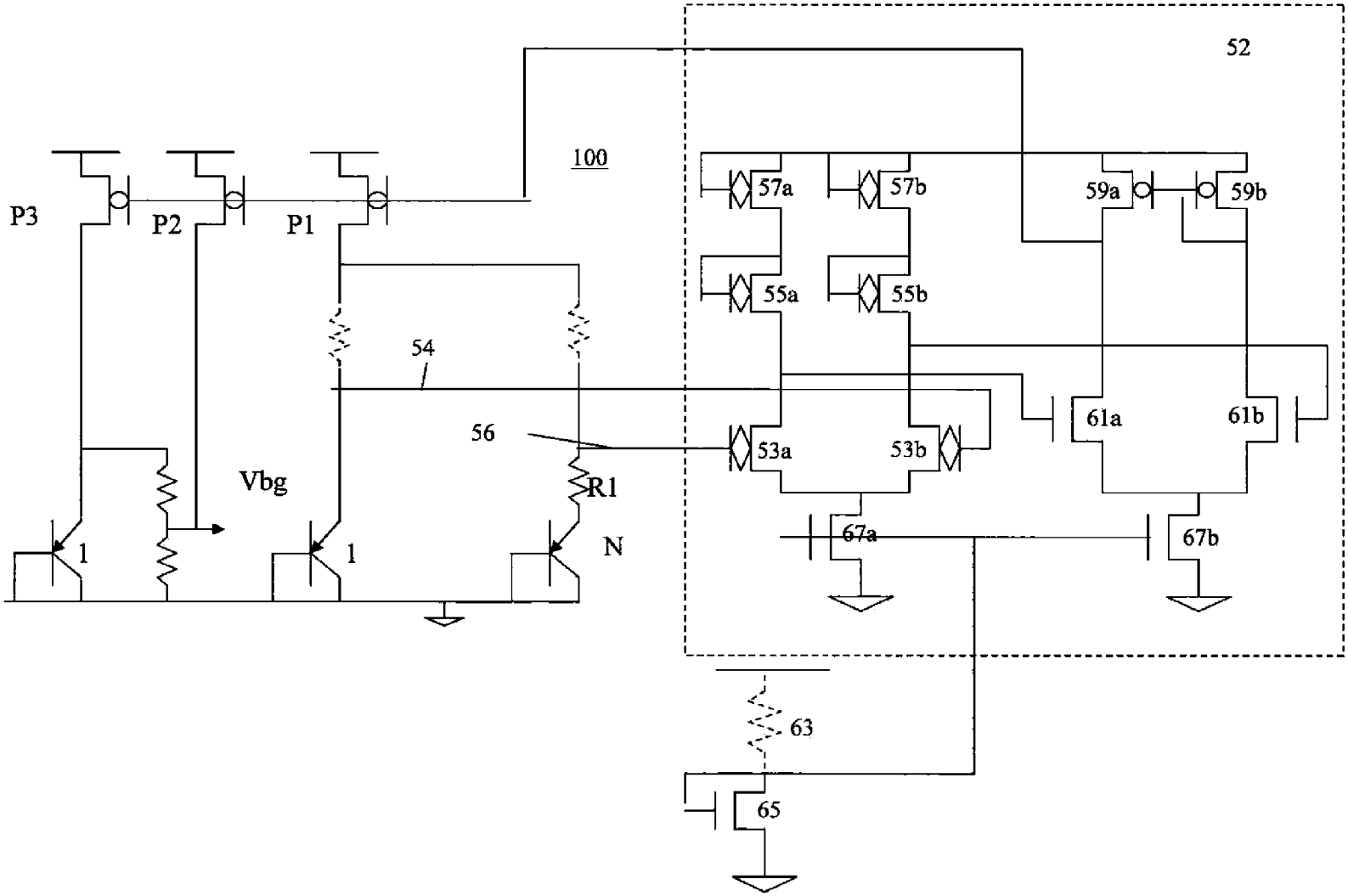
FIG. 8 is a circuit diagram of a fourth embodiment of the bandgap circuit of the present invention.

Referring to FIG. 8 there is shown a fourth embodiment of a circuit 100 of the present invention for the generation of a bandgap voltage. The circuit 100 is similar to the circuit 90 shown in FIG. 7. Thus, like numerals will be used for like parts. The only change between the circuit 100 and the circuit 90 is that the operational amplifier 52 is shown in greater detail. As shown in FIG. 8, the operational amplifier 52 comprises two stages of two cascading differential stages. The first stage consists of two native NMOS transistors 53(*a*-*b*) whose gates are supplied with the inputs 56 and 54, respectively. A native NMOS transistor has a threshold voltage substantially close to zero volt. An enhanced NMOS transistor has a threshold voltage around 0.3-1.0 volt. The drain of these native NMOS transistors 53(*a*-*b*) (which make a differential input pair) are connected to a pair of two series connected (cascoding load) native NMOS transistors 55(*a*-*b*) and 57(*a*-*b*) (which make up the output load for the input differential pair), with the two pair of transistors 55(*a*-*b*) and 57(*a*-*b*) connected to a positive power supply. Since only native transistors are used for the first stage, the circuit 100 operates at a very low voltage power supply, e.g. 1V Vdd, as well as low voltage input common mode range, e.g. 0.1V on the nodes 56/54. The drain of the input differential pair transistors 53(*a*-*b*) of the first stage are connected to the gate of a second stage enhancement NMOS differential input pair transistors 61(*a*-*b*). A pair of PMOS transistors 59(*a*-*b*) are connected to the drain of the second input differential pair transistors 61(*a*-*b*) and act as the output load for the second stage. An output signal from the second stage (connected to drain of the NMOS transistor 61*a* which has its gate connected to the drain of the native transistor 53*a* (of the first input differential pair) is the output of the operational amplifier. A resistor 63 connected to a positive power supply is connected to a diode-connected NMOS transistor 65 to provide a fixed bias current via two NMOS transistors 67(*a*-*b*) to supply the bias currents for the input differential pairs 53(*a*-*b*) for the operational amplifier 52. The fixed bias current is approximately proportional to power supply, (Vdd-VT)/R, VT is NMOS threshold voltage.

Figure 9:
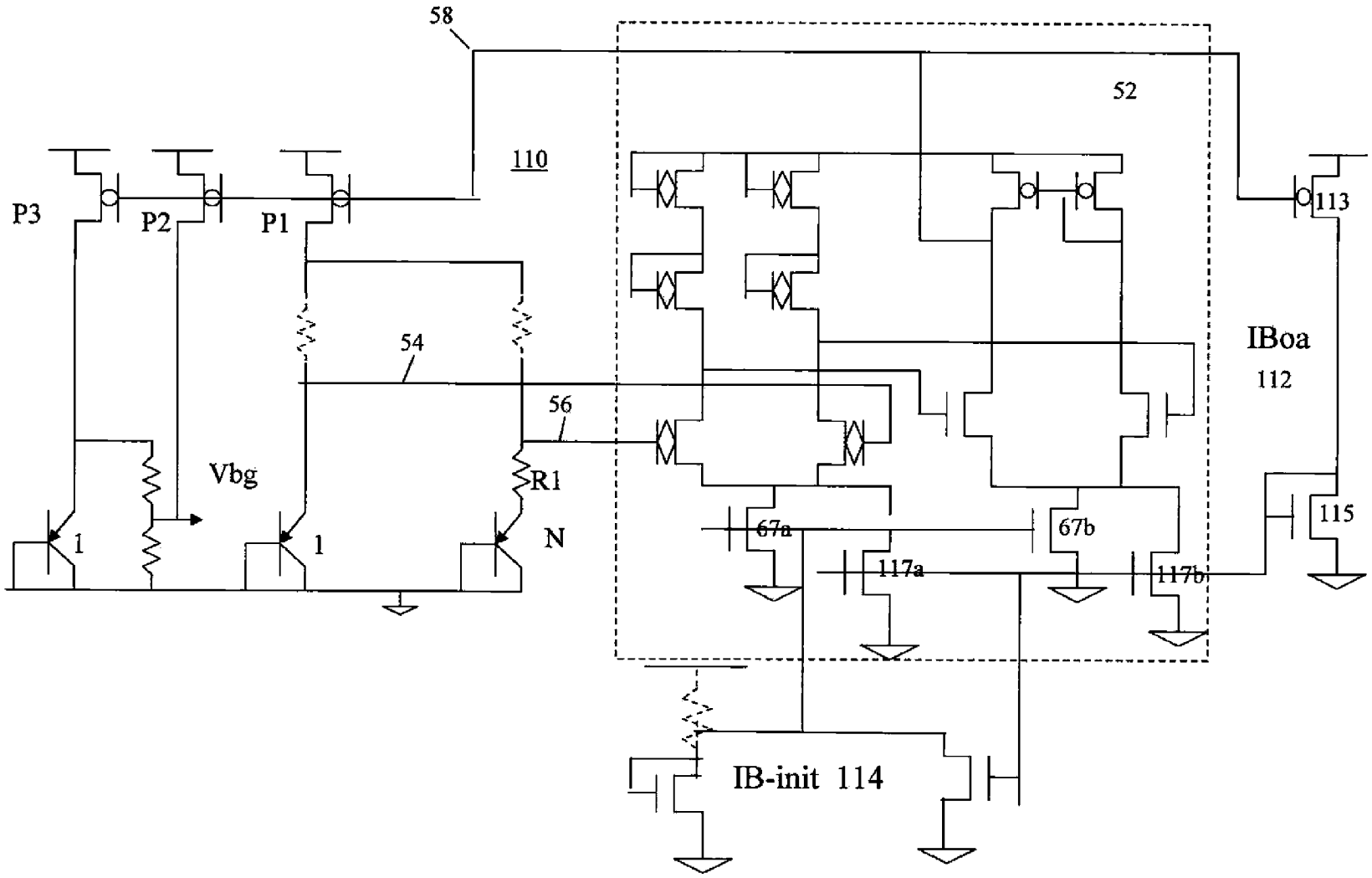
FIG. 9 is a circuit diagram of a fifth embodiment of the bandgap circuit of the present invention.

Referring to FIG. 9 there is shown a fifth embodiment of a circuit 110 of the present invention for the generation of a bandgap voltage. The circuit 110 is similar to the circuit 100 shown in FIG. 8. Thus, like numerals will be used for like parts. The only change between the circuit 110 and the circuit 100 is the addition of a IBoa (opamp bias current) circuit 112, and an IB-init (initial bias current) circuit 114, connected to the operational amplifier 52. The IBoa circuit 112 consists of a PMOS transistor 113 with its gate connected to the output of the operational amplifier 52. The PMOS transistor 113 is connected to a diode connected NMOS transistor 115. Once the operational amplifier 52 is operational, meaning its output provides a correct operating bias voltage on node 58, (to the gates of PMOS transistors P1/P2/P3), this bias voltage will cause a bias current (proportional to dVbe/R1, voltage difference between Vbe on nodes 54 and 56 divided by R1) to conduct in the IBoa circuit 112. In turn the diode connected NMOS transistor 115 in the circuit 112 will provide a bias voltage connecting to gates of additional bias transistors 117

(*a-b*) of the input differential pairs (in parallel to the original bias transistors 67(*a-b*) to the input differential pairs). The additional bias transistors 117(*a-b*) provide bias current (controlled from the IBoa 112 circuit) to the operational amplifier 52. This bias voltage also causes the original bias current to reduce to a minimum, e.g., 0ua, via the IB-init circuit 114 by pulling the gates of the original bias transistors 67(*a-b*) to low level, e.g. 0V. The IB-init circuit 114 reduces the bias current from the fixed bias current to the operational amplifier 52 as the IBoa circuit 112 provides the (operational) bias current to the operational amplifier 52. The IBoa circuit 112 comes up to a final bias operating current as the IB-init circuit 114 comes to an IB-init minimum.

Figure 10:
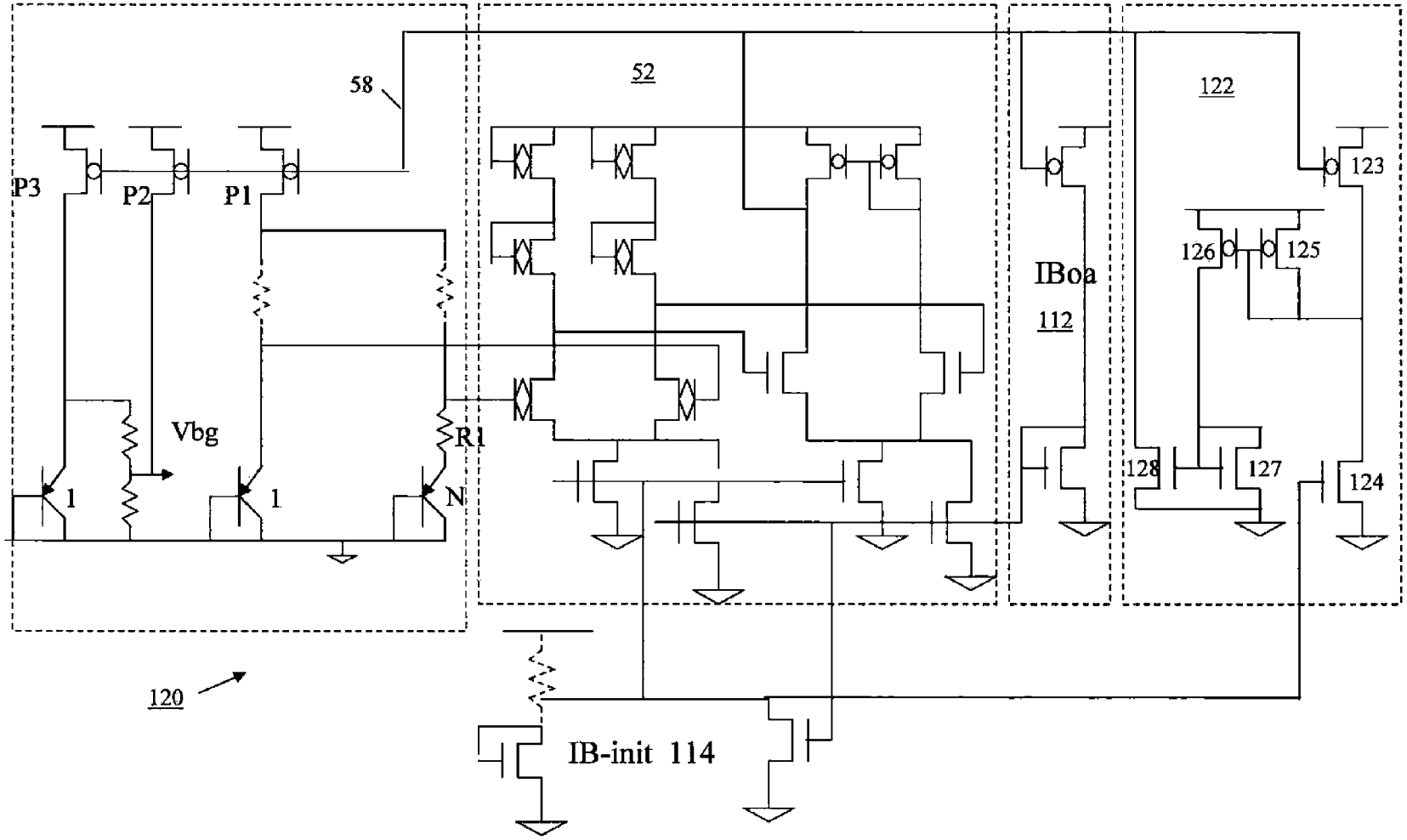
FIG. 10 is a circuit diagram of a sixth embodiment of the bandgap circuit of the present invention.

Referring to FIG. 10 there is shown a sixth embodiment of a circuit 120 of the present invention for the generation of a bandgap voltage. The circuit 120 is similar to the circuit 110 shown in FIG. 9. Thus, like numerals will be used for like parts. The only change between the circuit 120 and the circuit 110 is the addition of a start-up circuit 122, connected to the IBoa circuit 112. The IBoa circuit 112 functions as a self bias circuit to provide a self biasing voltage to the operational amplifier 52. The start up circuit 122 senses the output at node 58 of the op amp 52 to monitor if it is operational, meaning whether its value is low (less than Vcc), to determine whether PMOS transistor 123 is drawing current. If the PMOS transistor 123 is not drawing current, then a small amount of fixed current is provided by NMOS transistor 124 which is mirrored by PMOS transistors 125 and 126 and NMOS transistor 127 to NMOS transistor 128 to pull the output node 58 to a low value to inject a bias current into the PMOS transistors P1/P2/P3 which in turn pulls the input nodes 54/56 to the op amp 52 to a high value to start up the circuit. This starts the operational amplifier 52 and makes it operational.

Figure 11:
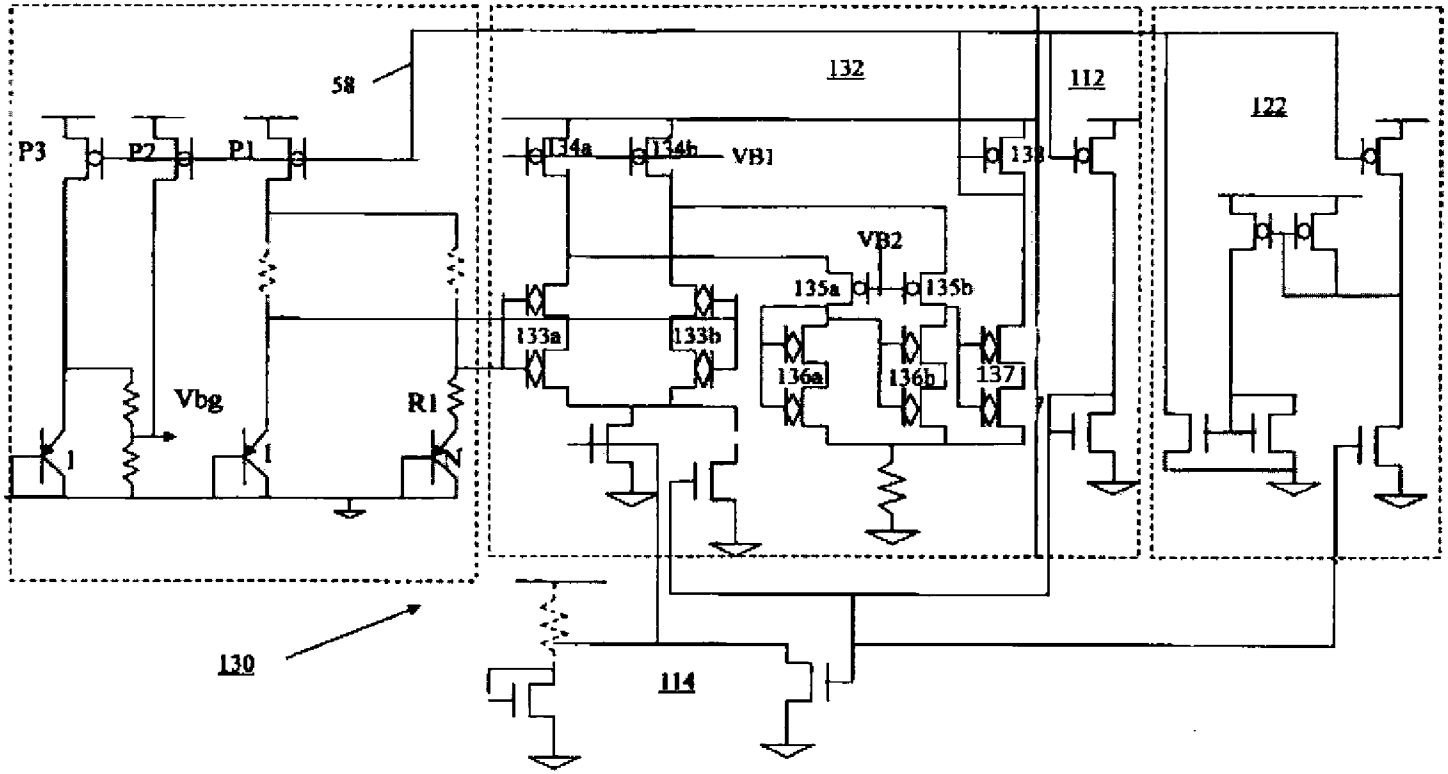
FIG. 11 is a circuit diagram of a seventh embodiment of the bandgap circuit of the present invention.

Referring to FIG. 11 there is shown a seventh embodiment of a circuit 130 of the present invention for the generation of a bandgap voltage. The circuit 130 is similar to the circuit 120 shown in FIG. 10. Thus, like numerals will be used for like parts. The only change between the circuit 130 and the circuit 120 is that the operational amplifier 132 shown in FIG. 11 is the same as the operational amplifier 52 shown in FIG. 10 but with a folded cascode structure. The folded cascade structure allows the op amp 132 to operate at a lower power supply voltage (since there is no diode connected PMOS load in the input differential stage). PMOS transistors 134(*a-b*) acts as load (current mirror load) for the input differential pair 133 (*a-b*) which shows two pair of native NMOS transistors connected (cascading) in series. Native NMOS transistors 136(*a-b*) (each one consists of two native NMOS transistors connected in series) (cascading) acts as NMOS current load for the current difference (from the input stage) which is folded through PMOS transistors 135(*a-b*). The drain of the transistor 136*b* is the output node of this NMOS current load. VB1 and VB2 supply appropriate bias voltage for the transistors 134(*a-b*) and 135(*a-b*) respectively. The output voltage of the transistor load 136(*a-b*) is then amplified by the final stage a common source amplifier) native transistors NMOS 137 and PMOS 138 to provide the output voltage node 58 of the op amp 132. Thus the operational amplifier 132 shown in FIG. 11 allows the circuit to operate at a lower power supply Vdd.

Figure 12:
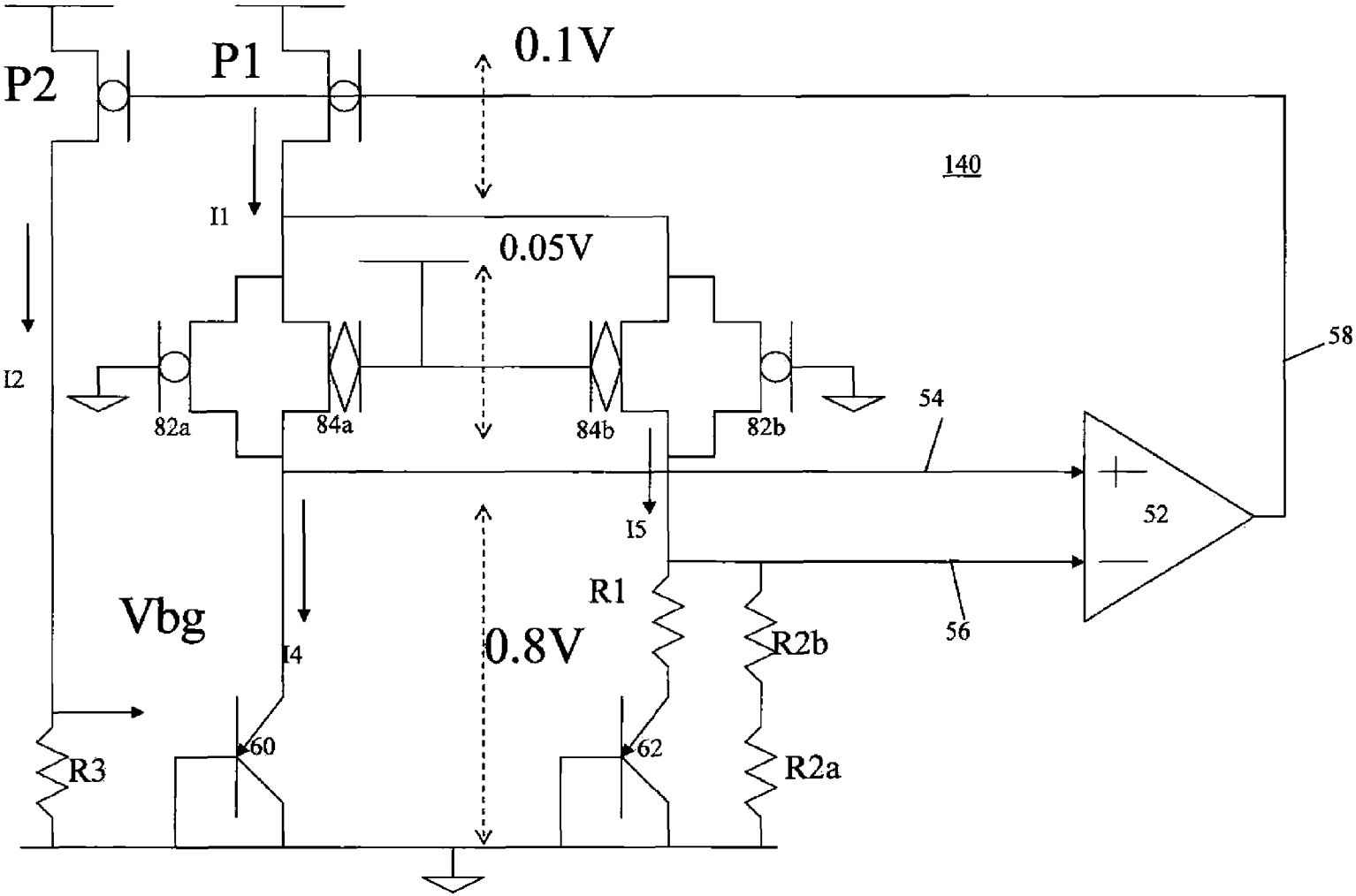
FIG. 12 is a circuit diagram of a eighth embodiment of the bandgap circuit of the present invention.

Referring to FIG. 12 there is shown an eighth embodiment of a circuit 140 of the present invention for the generation of a bandgap voltage. The circuit 140 is similar to the circuit 60 shown in FIG. 6. Thus, like numerals will be used for like parts. The circuit 140 comprises an operational amplifier 52 (which can also be the operational amplifier 132 shown in FIG. 11), which has a first non-inverting input 54, an inverting second input 56, and an output 58. The output 58 is connected to the gate of two PMOS transistors: P1 and P2. Each of the transistors P1 and P2 is connected in series with a current path I1 and 12, which are all connected in parallel. The output 58 controls the flow of current in the current paths I1 and I2. The current I1 and I2 are temperature independent currents (ZTC). The current path I1 is connected to parallel current subpaths: I4 and I5. Each of the current subpaths I4 and I5 has an equivalent current source connected in series. The current source are identical to the current sources shown in FIG. 6, comprising of a PMOS transistor connected in parallel with a native MOS transistor. The output of the current sources In and Ir, respectively, is connected to the inputs 54 and 56 to the operational amplifier 52 respectively. The current ratio of In/Ir is determined by the ratio of the size of transistors 82*a* and 84*a* over that of transistors 82*b* and 84*b*. The current source In is connected to the emitter of a PNP bipolar transistor 60, whose base and collector are connected to each other, and to ground. The current source Ir is connected to a resistor R1, which is then connected to the emitter of a PNP bipolar transistor 62, whose base and collector are connected to each other, and to ground. The current source Ir is also connected to a resistor, comprising of resistor R2*a* and resistor R2*b*, which collectively form a total resistance of R2, and then to ground. The emitter of the transistor 62 has a ratio of N times that of the emitter of the transistor 60. The second MOS transistor P2 is connected in series with the current path I2, which is connected to a resistor R3, and then to ground. At the connection to the resistor R3 is the output for the bandgap voltage.

In the operation of the circuit 140, the circuit 140 can be used with a very low voltage source of Vdd. The output bandgap voltage produced by the circuit 140 is $$Vbg=(R3/R2)*Vbe(\text{of transistor } PNP\ 60)+(R3/R1)*\text{delta } Vbe$$

Where delta Vbe=Vbe of transistor 60−Vbe of transistor 62

Figure 13:
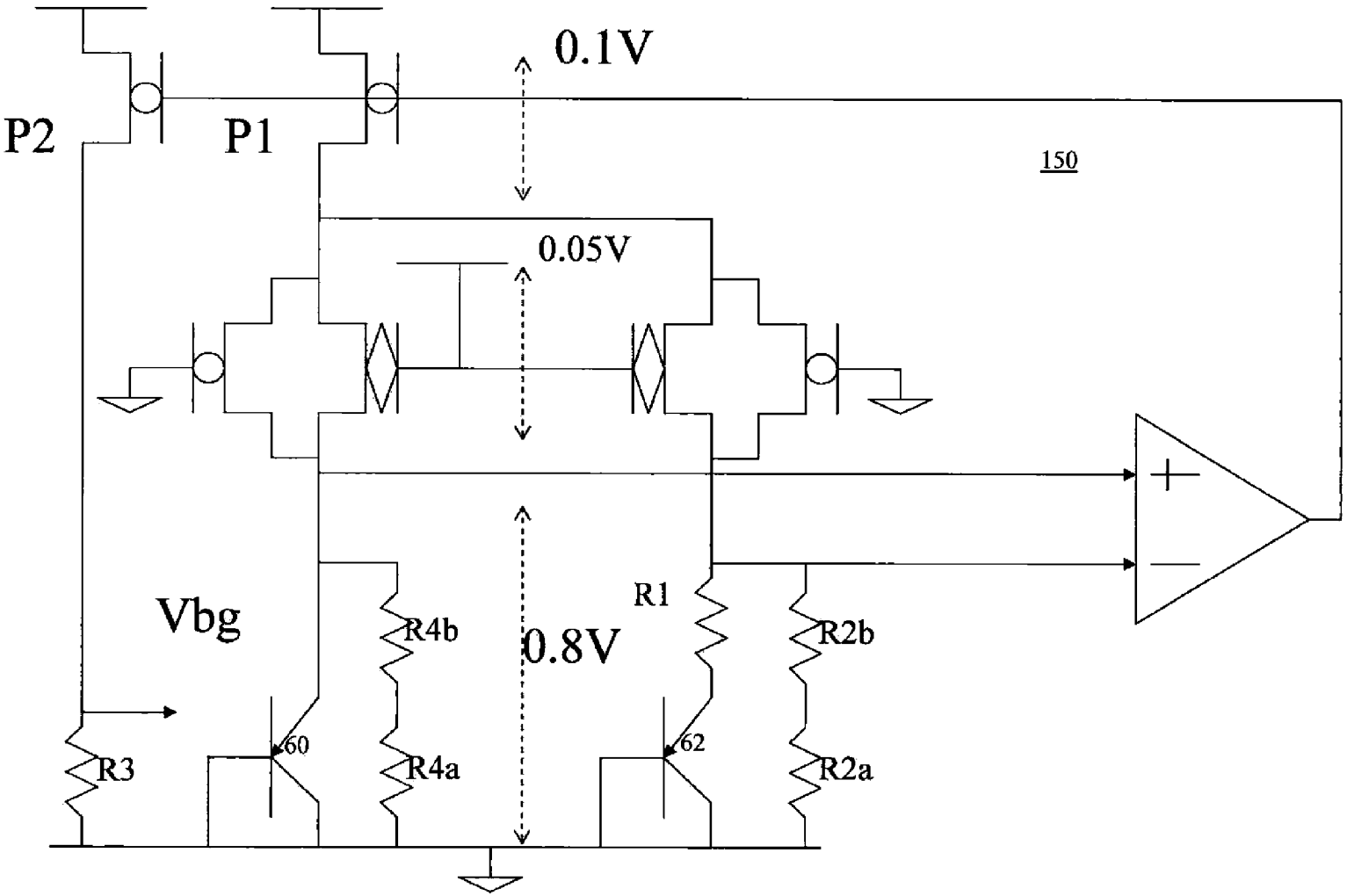
FIG. 13 is a circuit diagram of a ninth embodiment of the bandgap circuit of the present invention.

Referring to FIG. 13 there is shown a ninth embodiment of a circuit 150 of the present invention for the generation of a bandgap voltage. The circuit 150 is similar to the circuit 140 shown in FIG. 12. Thus, like numerals will be used for like parts. The circuit 150 has another resistor R4 connected in parallel with the bipolar transistor 60, in the same way resistor R2, which comprises resistors R2*a* and R2*b*, is connected in parallel with bipolar transistor 62. For illustration purpose, resistor R4 is shown as comprising two resistors R4*a* and R4*b* connected in series, and whose sum of the resistance equals R4, The resistor R4 is added in the current path I4 to balance the current flow of the resistor R2 in the current path I5. In all other aspects, the circuit 150 is identical to the circuit 140 and the operation of the circuit 150 is also identical to the operation of the circuit 140.

Figure 14:
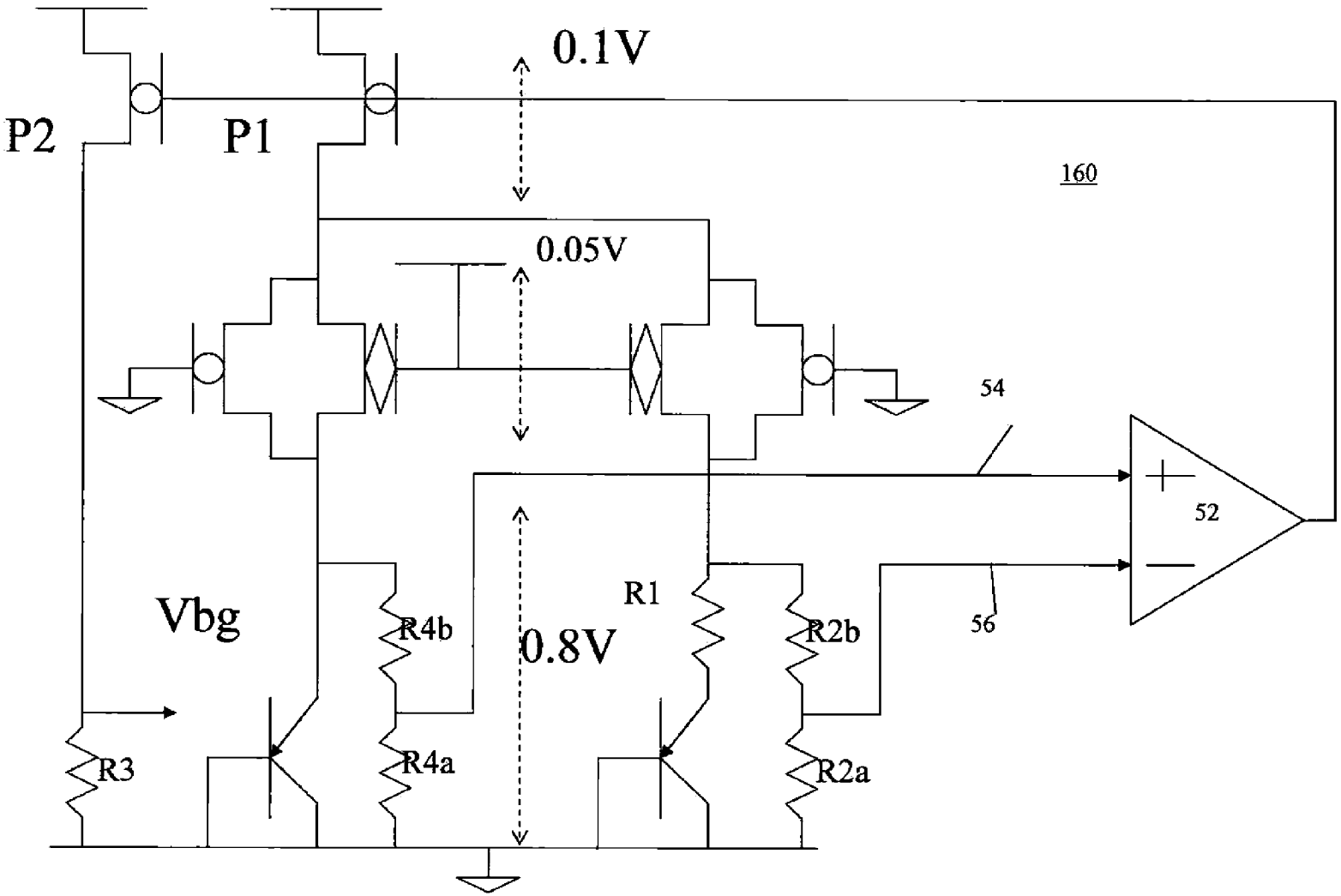
FIG. 14 is a circuit diagram of a tenth embodiment of the bandgap circuit of the present invention.

Referring to FIG. 14 there is shown a tenth embodiment of a circuit 160 of the present invention for the generation of a bandgap voltage. The circuit 160 is similar to the circuit 150 shown in FIG. 13. Thus, like numerals will be used for like parts. The circuit 160 has the non-inverting input 54 to the operational amplifier 52 connected to the connection of the resistor R4*a* and resistor R4*b*. In addition, the inverting input 56 is connected to the connection of the resistor R2*a* and resistor R2*b*. In all other aspects, the circuit 160 is identical to the circuit 150 and the operation of the circuit 160 is also identical to the operation of the circuit 150.

From the foregoing it can be seen that a low power bandgap circuit for generating a low voltage is disclosed, which is suitable for any electronic devices that uses battery for operation.

What is claimed is:

1. A bandgap voltage generating circuit for generating a bandgap voltage, said circuit comprising:

an operational amplifier having two inputs and an output;

a current mirror circuit having at least two parallel current paths, each of said current paths controlled by a signal from said output of said operational amplifier;

one of said current paths comprising two parallel subpaths with each subpath connected to a different one of the two inputs of the operational amplifier;

a resistor divide circuit connected to another of said current paths, said resistor divide circuit providing said bandgap voltage;

wherein one of the subpaths has a resistor connected in the subpath;

wherein each current path comprises a PMOS transistor controlling current between a source and a drain of the PMOS transistor with its gate coupled to the output of the operational amplifier and a bipolar transistor having an emitter/collector connected in series with the source/drain of the PMOS transistor;

wherein each of the subpaths has a current source;

wherein the current source in each subpath comprises a PMOS transistor and a native MOS transistor connected in parallel.

2. The voltage generating circuit of claim 1 wherein each of said PMOS transistors and native NMOS transistors have a gate with a control bias to simulate a pre-determined resistance value.

3. The voltage generating circuit of claim 1 wherein said resistor divide circuit comprises a first resistor and a second resistor connected in series at a node, with said node providing said bandgap voltage.

4. The voltage generating circuit of claim 3 wherein said first resistor and second resistor have substantially equal resistance values.

5. The voltage generating circuit of claim 1 wherein the resistor divide circuit is in parallel to one of the bipolar transistors.

6. The voltage generating circuit of claim 1 further comprising a third current path having a PMOS transistor connected to said bandgap voltage, with a gate of said PMOS transistor of the third current path coupled to the output of the operational amplifier.

7. The voltage generating circuit of claim 6 wherein said resistor divide circuit comprises a first resistor and a second resistor connected in series at a node, with said node providing the bandgap voltage, with said node connected to the PMOS transistor of the third current path.

8. The voltage generating circuit of claim 1 further comprising an operational amplifier bias current circuit connected to receive the output of the operational amplifier and for providing an operational amplifier biasing current to the operational amplifier.

9. The voltage generating circuit of claim 8 wherein said operational amplifier bias current circuit comprises a PMOS transistor having a gate connected to the output of the operational amplifier, and serially connected to a NMOS transistor connected to ground.

10. The voltage generating circuit of claim 8 further comprising an initial bias current circuit connected to the operational amplifier for reducing the operational amplifier bias current to the operational amplifier as the operational amplifier bias current circuit provides the operational amplifier bias current to the operational amplifier.

11. The voltage generating circuit of claim 1 wherein the operational amplifier is a two stage operational amplifier.

12. The voltage generating circuit of claim 11 wherein one of the two stages of the operational amplifier comprises native MOS transistors.

13. The voltage generating circuit of claim 12 wherein said native MOS transistors of the one of the two stages of the operational amplifier are in one of said two inputs to the operational amplifier.

14. The voltage generating circuit of claim 12 wherein said native MOS transistors of the one of the two stages of the operational amplifier are in the output of the operational amplifier.

15. The voltage generating circuit of claim 12 wherein said operational amplifier is a cascode operational amplifier.

16. The voltage generating circuit of claim 12 wherein a first stage of the operational amplifier is a folded cascode operational amplifier.

17. The voltage generating circuit of claim 16 wherein a second stage of the operational amplifier is a common source amplifier.

* * * * *